US005959517A

United States Patent [19]

Wieloch et al.

[11] Patent Number: 5,959,517

[45] Date of Patent: Sep. 28, 1999

[54] FAULT CURRENT TOLERABLE CONTACTOR

[75] Inventors: Christopher J. Wieloch; Xin Zhou, both of Brookfield, Wis.

[73] Assignee: Eaton Corporation, Cleveland, Ohio

[21] Appl. No.: 09/120,101

[22] Filed: Jul. 21, 1998

[51] Int. Cl.[6] ..... H01H 75/00

[52] U.S. Cl. ..... 335/16; 335/132; 218/22

[58] Field of Search ..... 335/132, 153, 335/16, 147, 195, 238, 243, 250, 260, 282, 283; 218/245, 22, 27, 23, 30, 33

[56] References Cited

U.S. PATENT DOCUMENTS 4,593,260 6/1986 Guero et al. ..... 335/195

*Primary Examiner*—Lincoln Donovan

*Attorney, Agent, or Firm*—Whyte Hirschboeck Dudek S.C.; Timothy J. Ziolowski; Larry G. Vande Zande

[57] ABSTRACT

A method an apparatus is disclosed for preventing contact welding during fault conditions. This fault current tolerable contactor includes two magnetic components, one in operable association with the movable contacts, and the other fixable attached above the movable contacts such that when a fault condition occurs, a high magnetic force is created to draw the two magnetic components together thereby opening the contacts. The magnetic force keeps the contacts open at least until current zero, and preferably a defined time thereafter to provide enough time for the contacts to cool and prevent welding upon the closure of the contacts.

31 Claims, 1 Drawing Sheet

FAULT CURRENT TOLERABLE CONTACTOR

BACKGROUND OF THE INVENTION

The present invention relates generally to contactors, and more particularly to a method and apparatus to prevent contacts from welding shut after a fault condition in an electromagnetic contactor.

In some applications, particularly in electromechanical motor controllers, a short circuit fault current condition generates an extremely high constriction force across the contact surfaces in a contactor. Such high constriction forces often overcomes the contact biasing forces and leads to the blow open of the contacts. Because of the rapid decrease of arc pressure difference across the movable contacts after the contacts are blown open, together with the increasing force created by the biasing spring when further compressed, the contacts will re-close within a few milliseconds, and usually well before the fault current has returned to current zero which can result in the permanent welding of the contacts. In other words, contact separation under short circuit conditions results routinely in an arcing between the movable and fixed contacts. This arcing can cause the contacts to melt on a momentary separation incident to the short circuit and if the contacts were to close together before the molten metal cools and solidifies, the fixed and movable contacts will become firmly and permanently welded together. Such welding can happen in a very short time interval due to the high current flow of the short circuit blowing open the contacts, which are then almost instantaneously forced closed by the reaction of the contact biasing spring.

In conventional contactors, no special means is provided to prevent blow open at short circuit fault currents except for the contact biasing springs. In an effort to overcome the effect of contact blow open, the typical approach is to use the magnetic force induced by the short circuit fault to keep the contacts closed during the high current. One example of such a system is disclosed in U.S. Pat. No. 3,887,888 in which a pair of magnetic members surround the contacts whereby on occurrence of a short circuit through the contacts, the magnetic members are attracted to one another thereby forcing the contacts together. Similarly, U.S. Pat. No. 4,513,270 uses the magnetic flux developed in a magnetic member when an overload current flows through a contactor generating electrodynamic forces to force the movable contacts against the stationary contacts so as to prevent the contacts from separating.

One disadvantage of attempting to keep the contacts closed during a short circuit is that such an approach is limited by either the magnetic saturation of the magnetic components that generate the force, or by a complex design of the current path resulting in an increased cost of the contactors. This problem is exaggerated when the FLA rating of a contactor is below 125 amps since current limiting circuit breakers have little protection below 10,000 amps.

Therefore, it would be desirable to have a method and apparatus that could prevent contact welding under fault conditions by opening the contacts relatively quickly upon the occurrence of a fault condition and maintaining the contacts open until the fault condition dissipates, thereby allowing the contact surfaces to cool sufficiently and ensure contact solidification before closure to allow closure without subsequent welding.

SUMMARY OF THE INVENTION

The present invention provides a method and apparatus that solves the aforementioned problems. As opposed to forcing the contacts into a closed position during a fault current condition, the present invention assists the contacts to open quickly by using the magnetic forces generated by the fault current and maintains the contacts in an open position until current zero, and preferably, several milliseconds after current zero. This approach allows the contact surfaces to cool sufficiently and solidify to avoid contact welding. Additionally, the add-on cost to a standard contactor is relatively low and the contactor provides some current limiting during the short circuit condition since the contactor provides an arc voltage to the circuit.

The present invention includes a contactor having a stationary contact mounted within a contactor housing and a movable contact mounted in operable association with the stationary contact. The movable contact is mounted within a window in a contact carrier which is movably mounted in the contactor housing and driven between contact closed and contact open positions by the electromagnetic drive mechanism (not shown) of the contactor in a well known manner. A spring is provided in the window, bearing upon the movable contact, to bias the movable contact against the stationary contact when the contacts are in a closed position. A pair of magnetic components are incorporated into the contact carrier. A first magnetic component is located adjacent the movable contact and a second is located remotely from both contacts on the opposite side of the movable contact from the first magnetic component. Fault current flowing through the movable contact creates a magnetic field in the magnetic components. This magnetic field provides an increasing magnetic force between the magnetic components during a fault condition which assists in the separation of the movable contact from the stationary contact and maintains contact separation until current zero. The distance which the movable contacts must travel to reclose on the stationary contacts requires adequate time for the contact surfaces to cool and solidify whereby the contacts can close without permanently welding together.

In accordance with another aspect of the invention, two methods of delaying contact closure after current zero are disclosed. In the first, the physical distance between the magnetic components is predetermined such that once the magnetic components are drawn together by a magnetic force generated from a fault current, they are held in place until the fault current subsides, at which time the force of the biasing spring overcomes the magnetic forces and the movable contact travels to the closed position. The time it takes to close is directly correlated to the gap created by the distance between the two magnetic components. Accordingly, increasing the gap will increase the delay time of contact closure after current zero, and decreasing the gap will decrease the time of contact closure after current zero. Another method of delaying contact closure includes using a magnetic material having increased residual flux to maintain contact separation for an extended time after current zero. Such a material may include permanent magnets with a constant magnetic flux and a properly sized biasing spring to create a contact closure delay time of sufficient length to allow the contacts to cool before closure. It is contemplated that other equivalent materials that promote a residual flux after current zero may be more desirable from a cost perspective.

In accordance with yet another aspect of the invention, a method of preventing contact welding under fault conditions in an electromagnetic contactor is disclosed. The method includes providing a pair of contacts, wherein at least one of the contacts is movable between a closed position and an open position with respect to the other contact. An electrical current path is provided through the contacts when the contacts are in the closed position. The invention includes creating a high magnetic force between a magnetic component associated with the movable contact and a stationary magnetic component that is located away from the movable contact in order to pull the contacts open during the presence of a fault current through the contacts.

The present invention is easily adaptable to common contactors and does not interfere with normal function of such a contactor. Further, since the magnetic components can be steel plates, the invention provides an extremely economical add-on cost to a conventional contactor to provide a fault current tolerable contactor.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings.

DETAILED DESCRIPTION OF THE PREFERRED EMBODIMENT

Figure 1:
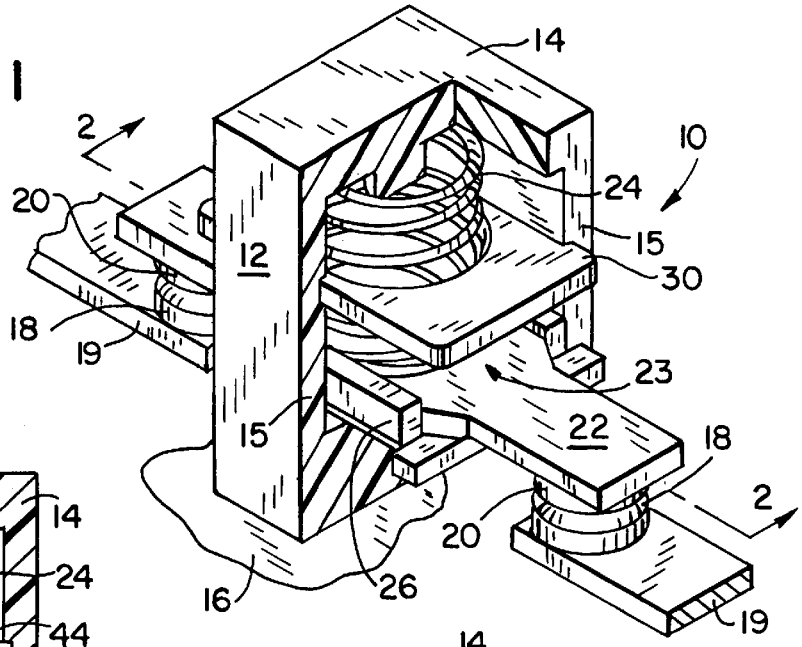
FIG. 1 is a prospective view of a contactor incorporating the present invention.

Referring to FIG. 1, a fault current tolerable contactor 10 is shown in perspective view. The contactor 10 has a movable contact carrier 12, which in turn has an upper enclosure 14, a pair of upwardly extending sides 15, and is movably mounted within a contactor housing 16. The movable contact carrier 12 is driven by a contactor operating mechanism (not shown) between a contact open position and a contact closed position in a well known manner. The contactor housing 16 has a pair of stationary contacts 18 mounted on conductors 19. A pair of movable contacts 20 are mounted to a contact bridge 22 in a window 23 in the contact carrier 12. The movable contacts 20 are additionally biased against the stationary contacts 18 when in the closed position, as shown in FIG. 1, by a biasing mechanism or spring 24 which is situated between the upper enclosure 14 of the movable contact carrier 12 and the contact bridge 22 supporting the movable contacts 20.

Figure 2:
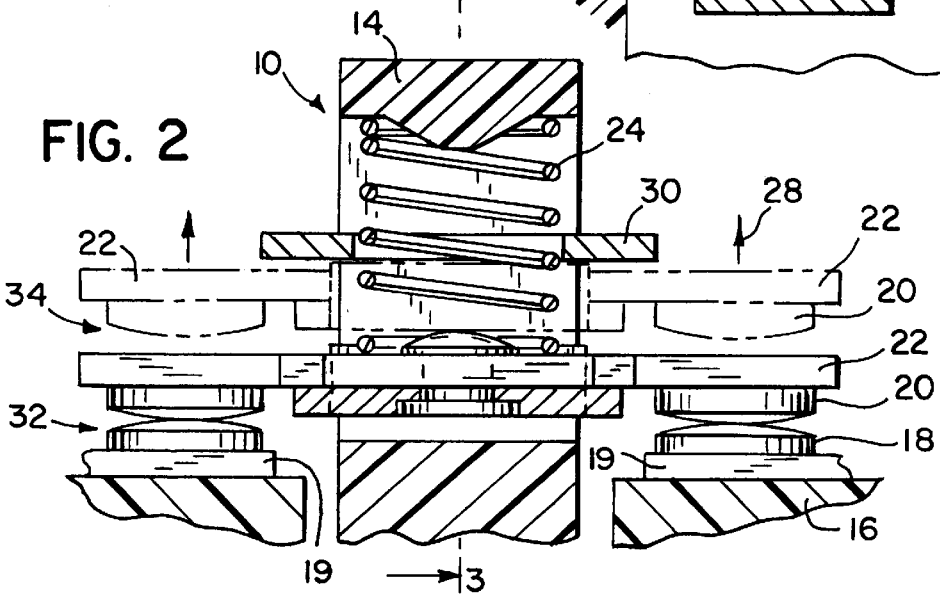
FIG. 2 is a longitudinal cross-sectional view of FIG. 1 taken along the line 2—2 of FIG. 1.

A first magnetic component 26 is located adjacent contact bridge 22 between the bridge 22 and a lower surface of window 23 and is movable with the movable contacts 20 and the contact bridge 22 in an upward direction 28, as indicated in phantom in FIG. 2. Referring back to FIG. 1, a second magnetic component 30 is fixably mounted to the upwardly extending sides 15 between the movable contacts 20 and the upper enclosure 14 a given distance away from the first magnetic component 26 when the movable contacts 20 are in a closed position.

Referring to FIG. 2, the contactor 10 is shown in a closed position 32 and phantomed in an open position 34. In the closed position 32, the movable contacts 20 are positioned to conduct electrical current through the stationary contacts 18, the conductors 19, and the contact bridge 22. When in the open position 34, the current path is interrupted.

Figure 3:
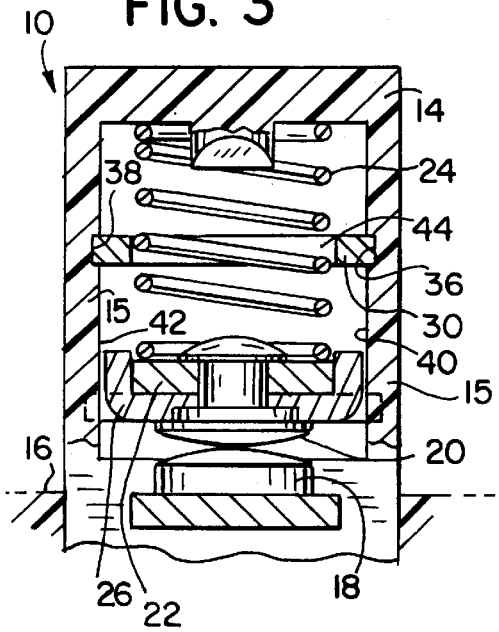
FIG. 3 is a lateral cross-sectional view taken along line 3—3 of FIG. 2.

FIG. 3 shows a detailed view of a portion of FIG. 2 with the contacts 18, 20 in the closed position. Each of the upwardly extending sides 15 in the movable contact carrier 12 has a slot 36, 38 on an inner wall 40, 42. The slots 36, 38 are parallel with one another to fixably retain the second magnetic component 30 therein. The second magnetic component 30 has a hollow center 44 allow the biasing mechanism 24 to compressibly move within the second magnetic component 30 free of interference.

Figure 4:
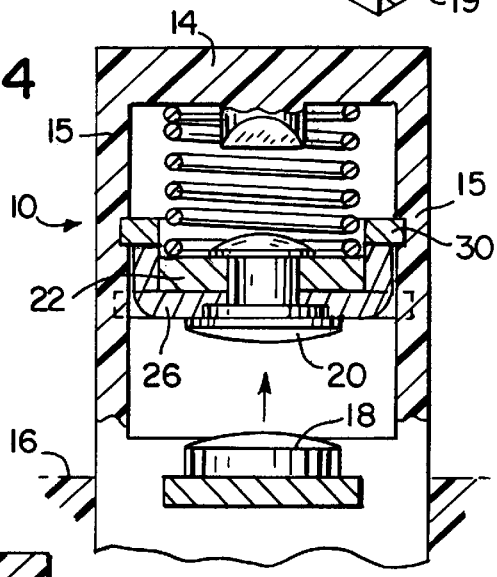
FIG. 4 is a view similar to that of FIG. 3, but with the contacts in an open position.

Referring to FIG. 4, the contactor 10 is shown with the stationary contacts 18 and the movable contacts 20 in the open position. In the preferred embodiment, the first magnetic component 26 is U-shaped such that when a fault current occurs through the contacts 18, 20, when closed, a high magnetic field is created between the first magnetic component 26 and the second magnetic component 30. This magnetic force pulls the first magnetic component 26 toward the stationary second magnetic component 30 thereby opening the contacts 18, 20, or assisting the opening during a blowopen condition, and maintaining the contacts open during the fault condition. As one skilled in the art will readily recognize, alternatively, the second magnetic component 30 could equivalently be U-shaped and the first magnetic component 26 could be U-shaped or planar. Other configurations could be adapted as long as the two magnetic components would be in physically close relationship with one another when the contacts are open.

In one embodiment, the magnetic components are comprised of a material with a high remnant flux density which allows a longer delay time before the contacts close after a zero current condition. In another embodiment, the delay of contact closing can also be adjusted by adjusting the physical gap between the two magnetic components. The magnetic components can be comprised of steel plates which have been found to adequately protect the contacts from welding during fault conditions, while at the same time adding minimal cost to the contactor both in terms of component cost and modification cost.

According to another aspect of the invention, a method of preventing contact weld under high fault current conditions in an electromagnetic contactor is disclosed. The method includes providing a pair of contacts, wherein the contacts are movable between a closed position and an opened position with respect to the other contact, and providing an electrical current path through the contacts when the contacts are in the closed position. The invention includes pulling the contacts open during the presence of a fault current through the contacts due to the creation of a magnetic force between the movable contact and a stationary magnetic component of a magnitude sufficient to maintain the contacts open for the duration of the fault condition. Once the contacts are opened and the fault dissipates, the invention can also maintain contact separation for a period of time dependent on either the remnant flux associated with the material used for the magnetic components or the physical distance between the magnetic components, as previously described. By physically varying the distance between the two magnetic components, the delay time until contact closure can be adjusted by adjusting the gap between the two magnetic components.

In this manner, the contacts are provided sufficient time to cool before closure which thereby prevents a welding of the contacts. An additional advantage is that the current through the contacts is limited during a fault condition due to a relatively quick opening of the contacts and because the contacts are maintained in an open position until the fault condition dissipates.

The present invention has been described in terms of the preferred embodiment, and it is recognized that equivalents, alternatives, and modifications, aside from those expressly stated, are possible and within the scope of the appending claims.

We claim:

1. A contactor comprising:

at least one stationary contact mounted within a contactor housing;

at least one movable contact mounted in operable association with the stationary contact; and first and second magnetic components, the first magnetic component located adjacent to and moveable with the movable contact and the second magnetic component located remotely from both the stationary and movable contacts and mounted rigidly with the contact carrier, such that a magnetic force generated between the first and second magnetic components as a result of a fault current through the contacts, causes an attraction between the first and second magnetic components to draw the first and second magnetic components toward one another, which thus encourages a separation or the movable contact from the stationary contact.

2. The contactor of claim 1 wherein the first and second magnetic components define therebetween a gap, such that when the contacts are in a closed position, the gap between the magnetic components is at a maximum, and when the contacts are in an open position, the gap between the magnetic components is at a minimum.

3. The contactor of claim 1 wherein at least one of the magnetic components is U-shaped.

4. The contactor of claim 1 wherein the second magnetic component has a hollow center to receive a biasing mechanism therein.

5. The contactor of claim 1 wherein the magnetic components are comprised of steel.

6. The contactor of claim 1 wherein the magnetic component associated with the movable contact is movable and the magnetic component located remotely from both contacts is stationary.

7. The contactor of claim 1 wherein the magnetic components are comprised of a material with a high residual flux to maintain the contacts in an open position after the fault current dissipates for a given time.

8. The contactor of claim 1 wherein the contacts remain open at least until the fault current is dissipated.

9. The contactor of claim 1 wherein the contacts remain open for a period after the fault current dissipates thereby preventing a welding of the contacts.

10. The contactor of claim 9 wherein a gap between the magnetic components defines a delay time for contact closing after a fault condition that causes the magnetic force dissipates.

11. A fault current tolerable contactor comprising:

a contactor housing having at least one stationary contact mounted therein;

a movable contact carrier having an upper enclosure and a pair of upwardly extending sides, the movable contact carrier being movable within the contactor housing between a contact open position and a contact closed position;

at least one movable contact mounted within the movable contact carrier and in operable association with the stationary contact, the at least one movable contact being switchable between an open position and a closed position, and while in the closed position, allowing electrical current to pass through the stationary and movable contacts;

a biasing mechanism situated between the upper enclosure of the movable contact carrier and the movable contact to bias the movable contact towards the stationary contact;

a first magnetic component fixedly mounted to the movable contact and movable with the movable contact;

a second magnetic component mounted between the movable contact and the upper enclosure and away from the first magnetic component when the movable contact is biased to the closed position; and wherein the presence of a fault current through the stationary and the movable contacts when in the closed position causes a magnetic field between the first and second magnetic components of such magnitude so as to assist in a separation of the contacts.

12. The fault current tolerable contactor of claim 11 wherein the contacts remain open until at least a zero current is reached and the fault current has thus dissipated.

13. The fault current tolerable contactor of claim 11 wherein the contacts remain open long enough for the contacts to cool and avoid contact welding after a fault current therethrough.

14. The fault current tolerable contactor of claim 11 further comprising a gap between the first and second magnetic components defining a delay time for contact closure after a fault current dissipates.

15. The fault current tolerable contactor of claim 11 wherein the first and second magnetic components are comprised of a magnetic material having substantial residual flux such that the residual flux is of a magnitude capable of delaying the time for contact closure after a fault current dissipates long enough to allow the contacts to cool.

16. The fault tolerable contactor of claim 11 wherein the upwardly extending sides of the moveable contact carrier each has a slot therein parallel to one another on an inner wall and the second magnetic component has a hollow center such that the biasing mechanism is compressible within the second magnetic component and wherein the second magnetic component is fixably mounted within the parallel slots of the upper enclosure.

17. The fault current tolerable contactor of claim 11 wherein at least one of the first magnetic component and the second magnetic component is U-shaped.

18. A method of preventing contact weld under fault conditions in an electromagnetic contactor comprising the steps of:

providing a pair of contacts wherein at least one contact is movable between a closed position and an open position with respect to the other contact;

providing an electrical current path through the contacts when the contacts are in the closed position;

pulling the contacts open during the presence of a fault current through the contacts due to the creation of a magnetic force between the movable contact and a stationary magnetic component of a magnitude sufficient to maintain the contacts open for the duration of the fault condition and;

providing a pair of magnetic components having a high remnant flux density to delay the time of closing the contacts until the fault condition has dissipated, one of the magnetic components being attached to the movable contact and the other attached away from the movable contact to open the contacts during a fault condition.

19. The method of claim 18 further comprising the step of maintaining a magnetic force to continue contact separation after the fault current dissipates.

20. The method of claim 19 further comprising the step of allowing the contacts sufficient time to cool before closure of the contacts thereby preventing a welding of the contacts.

21. The method of claim 18 further comprising the step of biasing the contacts into the closed position.

22. The method of claim 18 further comprising the step of limiting current through the electrical current path during a fault condition.

23. The method of claim 18 further comprising the step of providing a delay of contact closure time by providing a defined gap between the magnetic components thereby delaying closure until the contacts have cooled sufficiently to prevent contact welding.

24. A method of preventing contact weld under fault conditions in an electromagnetic contactor comprising the steps of:

providing a pair of contacts wherein at least one contact is movable between a closed position and an open position with respect to the other contact;

providing an electrical current path through the contacts when the contacts are in the closed position;

creating a magnetic force during a fault current by at least partially surrounding the electrical current path with a first magnetic component and locating a second magnetic component a fixed distance away from the first magnetic component such that the magnetic components are attracted to one another during the fault current; and pulling the contacts open during the presence of the fault current through the contacts due to the creation of the magnetic force between the movable contact and stationary magnetic component of a magnitude sufficient to maintain the contacts open for the duration of the fault condition.

25. The method of claim 24 further comprising the step of maintaining a magnetic force to continue contact separation after the fault current dissipates.

26. The method of claim 25 further comprising the step of allowing the contacts sufficient time to cool before closure of the contacts thereby preventing a welding of the contacts.

27. The method of claim 24 further comprising the step of biasing the contacts into the closed position.

28. The method of claim 24 further comprising the step of limiting current through the electrical current path during a fault condition.

29. The method of claim 24 further comprising the step providing a delay of contact closure time by providing a defined gap between the magnetic components thereby delaying closure until the contacts have cooled sufficiently to prevent contact welding.

30. In a contactor having a pair of stationary contacts mounted within a contactor housing and a pair of movable contacts mounted in operable association with the stationary contacts, and having a biasing mechanism applying a spring force urging the movable contacts toward the stationary contacts, and having a first and a second magnetic component, the improvement comprising: locating the first magnetic component adjacent to and in movable relation with the movable contacts and locating the second magnetic component remotely from both of the stationary contacts and the movable contacts such that the second magnetic component is further from the stationary and the movable contacts than the first magnetic component so that when the contacts are in a closed position, the spring force separates the first and second magnetic components and an occurrence of a fault current through the contacts creates a magnetic force between the first and second magnetic components acting to separate the movable contacts from the stationary contacts.

31. The contactor of claim 30 wherein the second magnetic component is rigidly mounted above the first magnetic component, away from both contacts, and about the biasing mechanism such that the magnetic force created by a fault current opposes the spring force created by the biasing mechanism to thereby open the contacts during the fault current.

* * * * *